US009265341B2

(12) United States Patent
Siegel et al.

(10) Patent No.: US 9,265,341 B2
(45) Date of Patent: Feb. 23, 2016

(54) MODULAR SYSTEM

(75) Inventors: Fred Siegel, Philadelphia, PA (US); Klaus Rosburg, Brooklyn, NY (US); Jerry Zucker, Los Angeles, CA (US)

(73) Assignee: Happy Cabinet, LLC, Los Angeles, CA (US)

( * ) Notice: Subject to any disclaimer, the term of this patent is extended or adjusted under 35 U.S.C. 154(b) by 0 days.

(21) Appl. No.: 13/513,298

(22) PCT Filed: Dec. 1, 2010

(86) PCT No.: PCT/US2010/058506

§ 371 (c)(1), (2), (4) Date: Jun. 1, 2012

(87) PCT Pub. No.: WO2011/068836

PCT Pub. Date: Jun. 9, 2011

(65) Prior Publication Data

US 2012/0233938 A1 Sep. 20, 2012

Related U.S. Application Data

(60) Provisional application No. 61/266,154, filed on Dec. 2, 2009.

(51) Int. Cl.

| | |
|---|---|
| ***E04C 2/38*** | (2006.01) |
| ***A47B 47/00*** | (2006.01) |
| ***A47B 57/00*** | (2006.01) |
| ***A47B 87/02*** | (2006.01) |
| *A47F 5/08* | (2006.01) |

(52) U.S. Cl.

CPC ..... *A47B 47/0091* (2013.01); *A47B 57/00* (2013.01); *A47B 87/0292* (2013.01); *A47F 5/08* (2013.01); *Y10T 29/49947* (2015.01)

(58) Field of Classification Search

CPC ..... A47B 47/0091; A47B 47/021; A47B 47/025; A47B 47/04; A47B 87/0292; A47B 57/00; A47F 5/0823; A47F 5/0869; A47F 5/0861; A47F 5/0807; A47F 5/0846

USPC ..... 312/245; 211/57.1, 59.1, 54.1, 70.6; 248/220.31–220.43

See application file for complete search history.

(56) References Cited

U.S. PATENT DOCUMENTS

| | | | | | |
|---|---|---|---|---|---|
| 3,322,287 | A * | 5/1967 | Ragir | A47F 5/0807 | 211/87.01 |
| 3,452,959 | A * | 7/1969 | Sadao | A47F 5/0815 | 248/220.31 |
| 4,118,085 | A * | 10/1978 | Fibus | B25H 3/00 | 312/199 |
| 4,155,609 | A * | 5/1979 | Skafte | A47B 85/08 | 108/48 |
| 4,573,513 | A * | 3/1986 | Small | A47G 5/00 | 160/135 |

(Continued)

OTHER PUBLICATIONS

International Preliminary Report on Patent Ability for PCT/US2010/058506 dated Jun. 14, 2012.

*Primary Examiner* — Brian Glessner
*Assistant Examiner* — Adam Barlow
(74) *Attorney, Agent, or Firm* — Steptoe & Johnson LLP

(57) ABSTRACT

A modular tile adapted for mounting onto a flat surface, comprising an edge connector; an edge receiver configured to accommodate the connector; and a plurality of flat units, wherein each unit comprises a central opening with two dimensions with a first dimension smaller than a second dimension. The modular tiles are connected by releasably securing an edge connector of a first modular tile to an edge receiver of a second modular tile.

14 Claims, 13 Drawing Sheets

(56) References Cited

U.S. PATENT DOCUMENTS 4,694,965 A 9/1987 Parnell
4,887,783 A * 12/1989 Franklin ..... A47F 5/0815 211/87.01
4,932,538 A * 6/1990 Gambello ..... A47F 5/0846 211/59.1
6,945,414 B1 * 9/2005 Stevens ..... A47F 5/0846 211/183
7,798,338 B2 * 9/2010 Maheu ..... A47F 5/0815 211/103
2005/0072746 A1 * 4/2005 O'Brien ..... A47F 5/0823 211/59.1
2008/0257840 A1 * 10/2008 Eley ..... A47F 5/0815 211/59.1

* cited by examiner

MODULAR SYSTEM

CLAIM FOR PRIORITY

This application claims priority under 35 USC 371 to International Application No. PCT/US2010/058506, filed on Dec. 1, 2010, which claims priority to U.S. Patent Application No. 61/266,154, filed on Dec. 2, 2009, each of which is hereby incorporated by reference in its entirety.

TECHNICAL FIELD

This invention relates to a modular system for storage, for example, by tiling in a cabinet, closet or on a wall. The modular tile can include an edge connector and a plurality of flat units.

BACKGROUND

Medicine cabinets and bathroom storage cabinets have been used in many residential homes. These cabinets are typically made of aluminum or steel.

SUMMARY

A modular tile adapted for mounting onto a flat surface can include an edge connector, an edge receiver configured to accommodate the connector, and a plurality of flat units. Each unit can include a central opening with two dimensions with a first dimension smaller than a second dimension. At least two modular tiles can be connected by releasably securing an edge connector of a first modular tile to an edge receiver of a second modular tile. The modular tile can include a four-by-four (4×4) or an eight-by-eight (8×8) unit configuration. The modular tile can include a metal or plastic. Each flat unit can be in a shape of a square or hexagon. The modular tile can include an organizing unit having a rear mounting member configured to releasably secure to the modular tile by engaging at least one central opening and extending into a region between the first dimension and the second dimension. The organizing unit can be a drawer unit, a storage cube, a utility clip or a hook.

A modular system can include a housing adapted for mounting onto a flat surface and a tile. The housing can include a rear wall joined to a forwardly projecting top wall, bottom wall, and a pair of side walls to define a forwardly open chamber. The tile can be attached to the rear wall of the housing. The tile can include a plurality of flat units. Each unit can include a central opening with two dimensions with a first dimension smaller than a second dimension. The system can include an organizing unit having a rear mounting member configured to releasably secure to the modular tile by engaging at least one central opening and extending into a region between the first dimension and the second dimension. The organizing unit can be a drawer unit, a storage cube, a utility clip or a hook.

An organizer system can include at least one modular tile and an organizing unit. The modular tile can include an edge connector, an edge receiver configured to accommodate the connector, and a plurality of flat units. Each unit can include a central opening with two dimensions with a first dimension smaller than a second dimension. The organizing unit can include a rear mounting member configured to releasably secure to the modular tile by engaging at least one central opening and extending into a region between the first dimension and the second dimension.

The organizing unit can be a drawer unit, a storage cube, a utility clip or a hook. The rear mounting member can be configured to engage at lease two regions of the central opening.

A method of assembling a modular tiling system can include providing at least two modular tiles. Each modular tile can include an edge connector, an edge receiver configured to accommodate the connector, and a plurality of flat units. Each unit can include a central opening with two dimensions with a first dimension smaller than a second dimension. The method can include connecting two modular tiles by releasably securing a edge connector of a first modular tile to a edge receiver of a second modular tile and mounting the assembled modular tiles onto a flat surface.

Each modular tile can include a four-by-four (4×4) unit configuration or an eight-by-eight (8×8) unit configuration. The modular tile can include a metal or a plastic. Each flat unit can be in a shape of a square or a hexagon. The method can further include releasably securing an organizing unit having a rear mounting member to the modular tile by engaging at least one central opening and extending into a region between the first dimension and the second dimension. The organizing unit can be a drawer unit, a storage cube, a utility clip or a hook.

In another aspect, a method of assembling a modular system can include providing a first modular tile and a housing and securing the tile to a rear wall of a housing. Each modular tile can include an edge connector, an edge receiver configured to accommodate the connector, and a plurality of flat units, each unit including a central opening with two dimensions with a first dimension smaller than a second dimension. The method can further include providing a second modular tile and mounting the second modular tile onto a wall of the housing including engaging the edge connector of the first modular tile with the edge receiver of the second modular tile or engaging the edge connector of the second modular tile with the edge receiver of the first modular tile. The modular tile can include a four-by-four (4×4) unit configuration or an eight-by-eight (8×8) unit configuration. The modular tile can include a metal or a plastic. Each flat unit can be in the shape of a square or a hexagon. The method can further include releasably securing an organizing unit having a rear mounting member to the modular tile by engaging at least one central opening and extending into a region between the first dimension and the second dimension. The organizing unit can be a drawer unit, a storage cube, a utility clip or a hook.

The details of one or more embodiments are set forth in the accompanying drawings and the description below. Other features, objects, and advantages of the invention will be apparent from the description and drawings, and from the claims.

DETAILED DESCRIPTION

Medicine cabinets and bathroom storage cabinets have been used in many residential homes. The vast majority of these cabinets consist of a mirrored door that swings open, revealing two or three shelves inside the cabinet structure. These shelves often are made of glass and rest on metal or plastic clips to enable them to be adjusted higher or lower within the cabinet. Occasionally, these shelves are made of metal or strong plastic, and most of the shelves are moveable to different heights within the cabinet, or are able to be removed completely. These cabinets are typically made of aluminum or steel.

A modular tiling system is developed to create storage space in any cabinet, storage room, kitchen area, closet, or wall. The modular tiling system is easy to assemble and customizable to any room, whether to store tools, hardware, or garden supplies, or pots, pans, kitchen tools, etc. It can be used for bathroom storage cabinets, to create more storage capacity and organization to items stored in the cabinets. Moreover, the modular tiling system can also be used in kitchen, garage, or any residential or small commercial application where organization of storage is desired.

Figure 1:
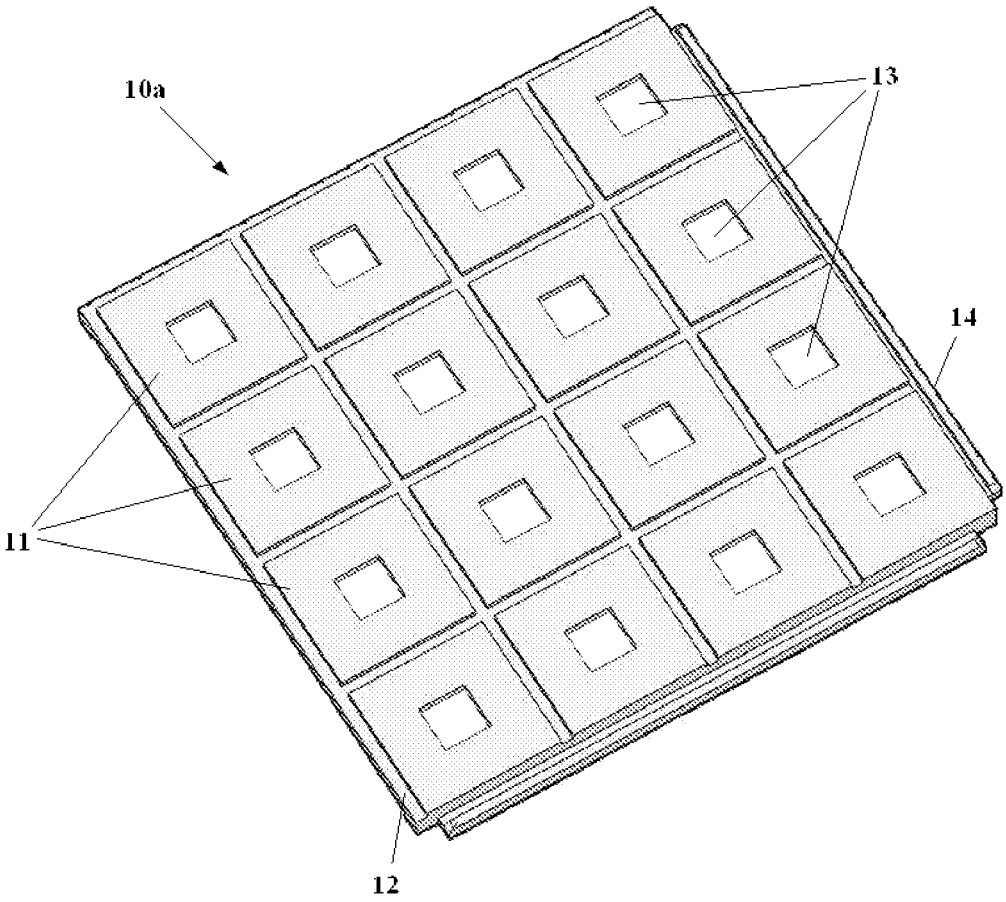
FIG. 1 illustrates a modular tile.
Figure 1A:
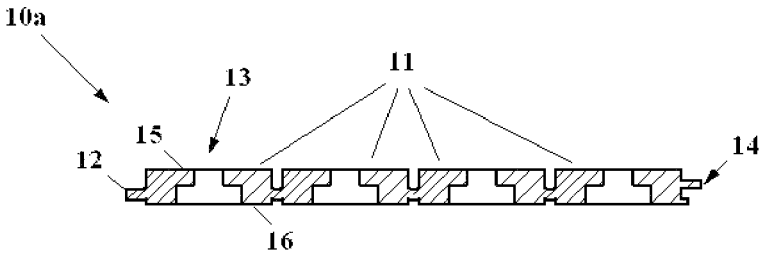
FIG. 1A illustrates a cross section of a modular tile.
Figure 2:
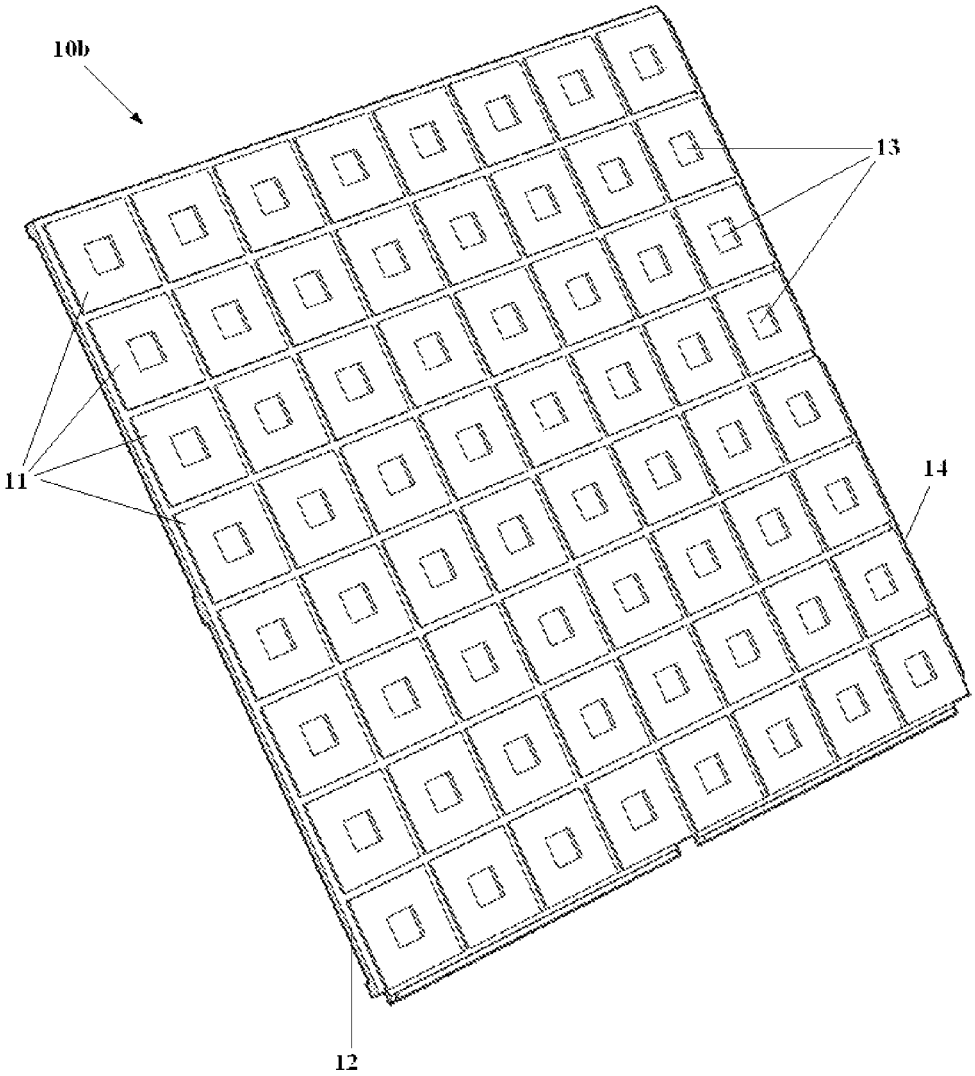
FIG. 2 illustrates a modular tile.

As shown in FIGS. 1, 1A, and 2, a modular tile can include edge connector 12, edge receiver 14, and a plurality of flat units 11. Edge receiver 14 can be configured to accommodate connector 12. Each unit 11 can have first surface 15, second surface 16, and central opening 13. Central opening 13 can have two dimensions. The part of opening 13 adjacent to first surface 15 can have a first dimension smaller than a second dimension of the part of opening 13 adjacent to second surface 16. In FIG. 1, modular tile 10*a* can have a four-by-four (4×4) unit configuration. In FIG. 2, modular tile 10*b* can have an eight-by-eight (8×8) unit configuration. In some embodiments, modular tile can have any suitable configuration, such like 2×4, 3×3, 3×5, 5×5, 5×6, 5×7, 7×7, 5×8, or 6×8. Two modular tiles can be connected by releasably securing an edge connector of a first modular tile to an edge receiver of a second modular tile. In other embodiments, modular tile can have a uniform configuration, such as 10×10 or larger, which can be further dissembled and resembled to any customizable smaller configuration and dimension.

The modular tile can include a metal or plastic. Each flat unit can be in the shape of a square, hexagon, rectangle, triangle, parallelogram, rhombus, or any suitable polygon.

Figure 3:
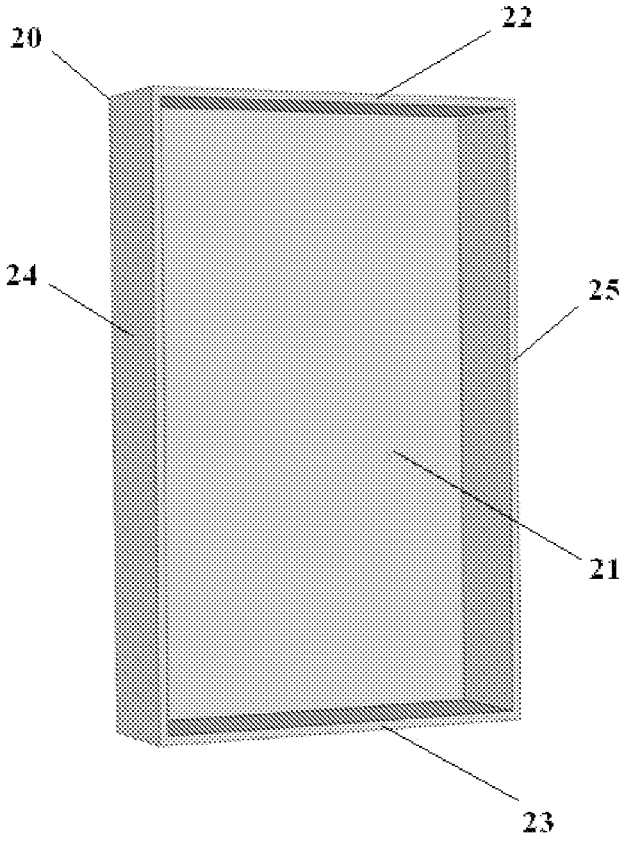
FIG. 3 illustrates a housing of a modular tiling cabinet.
Figure 4:
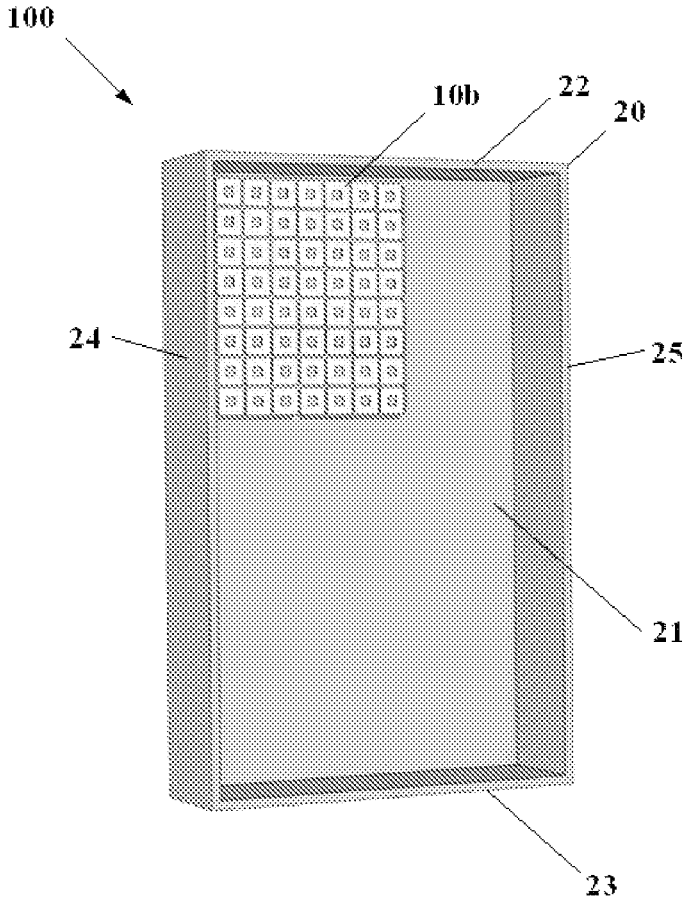
FIG. 4 illustrates a modular tiling cabinet.
Figure 5:
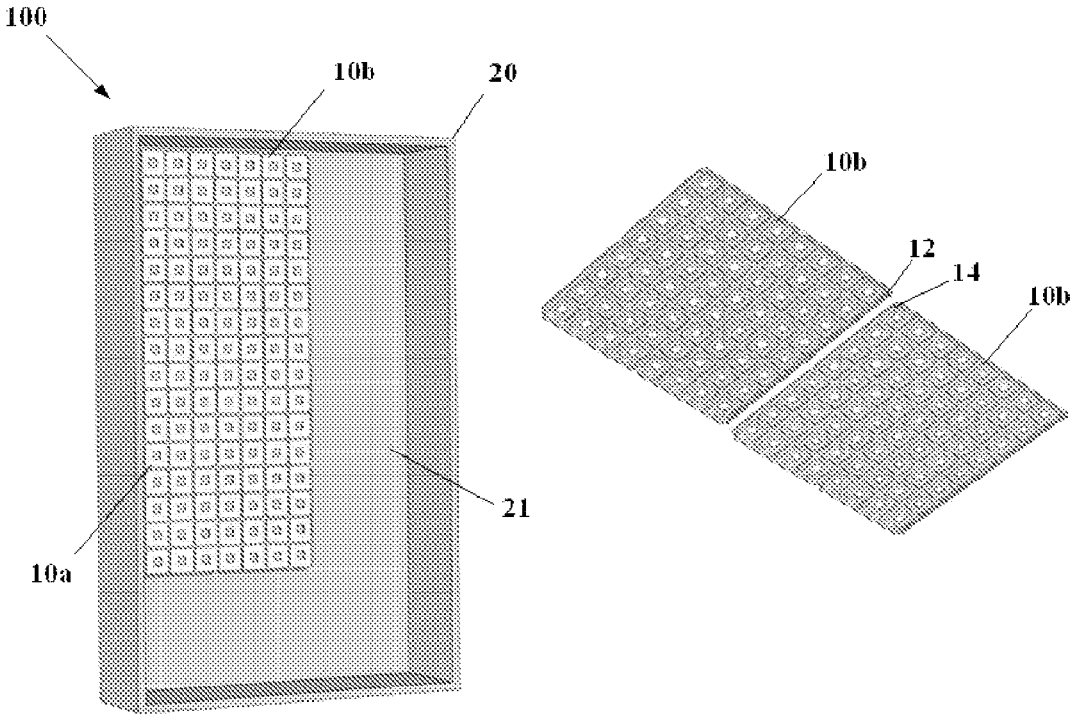
FIG. 5 illustrates a modular tiling cabinet.
Figure 6:
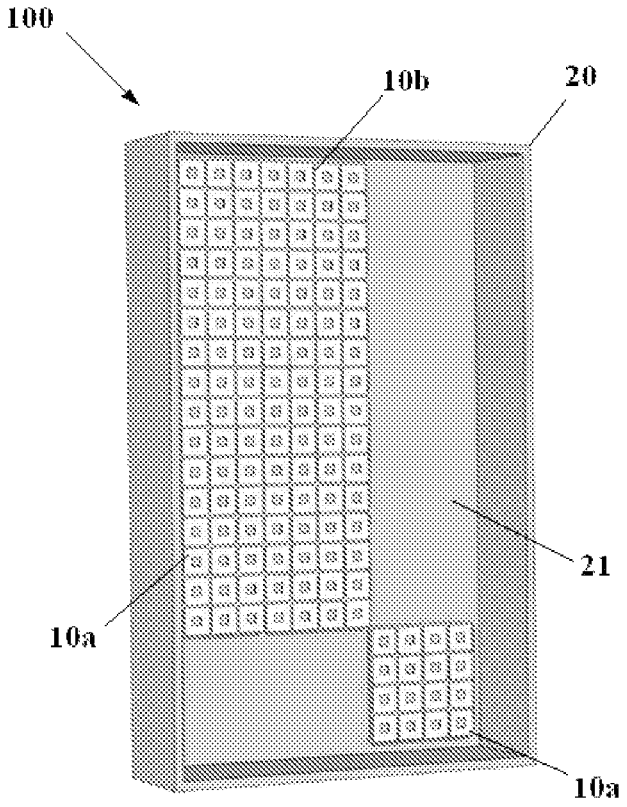
FIG. 6 illustrates a modular tiling cabinet.
Figure 7:
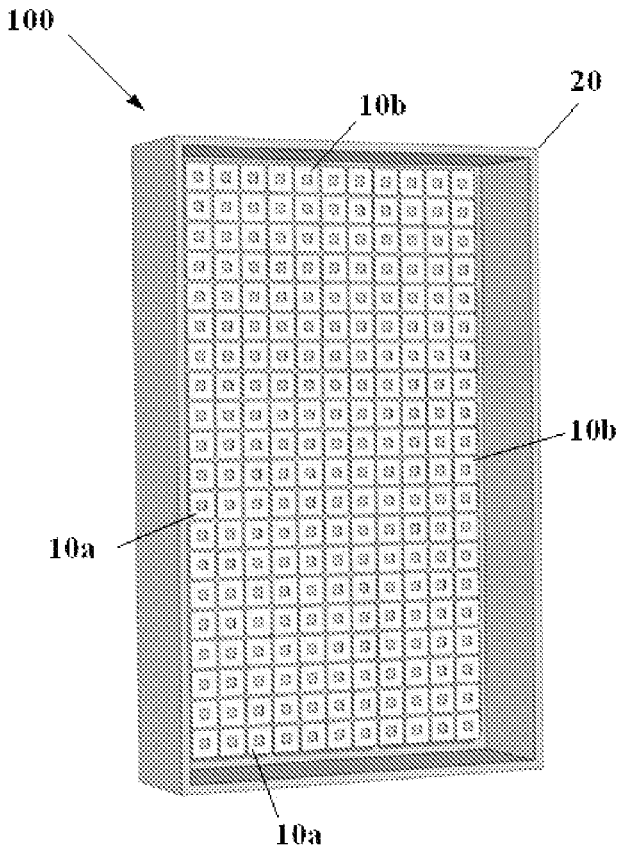
FIG. 7 illustrates a modular tiling cabinet.

As shown in FIG. 3, a modular tiling cabinet can include housing 20 adapted for mounting onto a flat surface. Housing 20 can include rear wall 21 joined to forwardly projecting top wall 22, bottom wall 23, and a pair of side walls 24 and 25 to define a forwardly open chamber.

As shown in FIGS. 4 through 7, modular tiling cabinet 100 can include housing 20 and at least one modular tile 10*a* or 10*b*. The tile can be attached to rear wall 21 of housing 20 with screws or adhesive tape. As can be found in the figures, a larger tile, such as 10*b*, can be attached to rear wall 21 and smaller tiles, such as 10*a*, can be used to fill in the remaining uncovered space of rear wall 21 of cabinet 100, creating a panel that covers maximum surface area of rear wall 21.

Before being mounted onto the rear wall, two modular tiles (10*b* in FIG. 5) can be connected by releasably securing an edge connector (12 in FIG. 5) of a first modular tile to an edge receiver (14 in FIG. 5) of a second modular tile.

In other embodiments, a method of assembling a modular system can include providing a first modular tile (10*b* in FIG. 5) and a housing (20 in FIG. 5) and securing the tile to a rear wall of a housing. Each modular tile can include an edge connector, an edge receiver configured to accommodate the connector, and a plurality of flat units, each unit including a central opening with two dimensions with a first dimension smaller than a second dimension. The method can further include providing a second modular tile and mounting the second modular tile onto a wall of the housing including engaging the edge connector (12 in FIG. 5) of the first modular tile with the edge receiver (14 in FIG. 5) of the second modular tile or engaging the edge connector of the second modular tile with the edge receiver of the first modular tile.

In other embodiments, the modular tile can also be attached to a rear wall of any given cabinet. With the customizable configuration of modular tiles, the rear wall of the cabinet can have a maximum surface area coverage.

The modular tile can include an organizing unit having a rear mounting member configured to releasably secure to the modular tile by engaging at least one central opening and extending into a region between the first dimension and the second dimension. The organizing unit can be a drawer unit, a storage cube, a utility clip or a hook. The rear mounting member can be configured to engage at lease two regions of the central opening.

Figure 8:
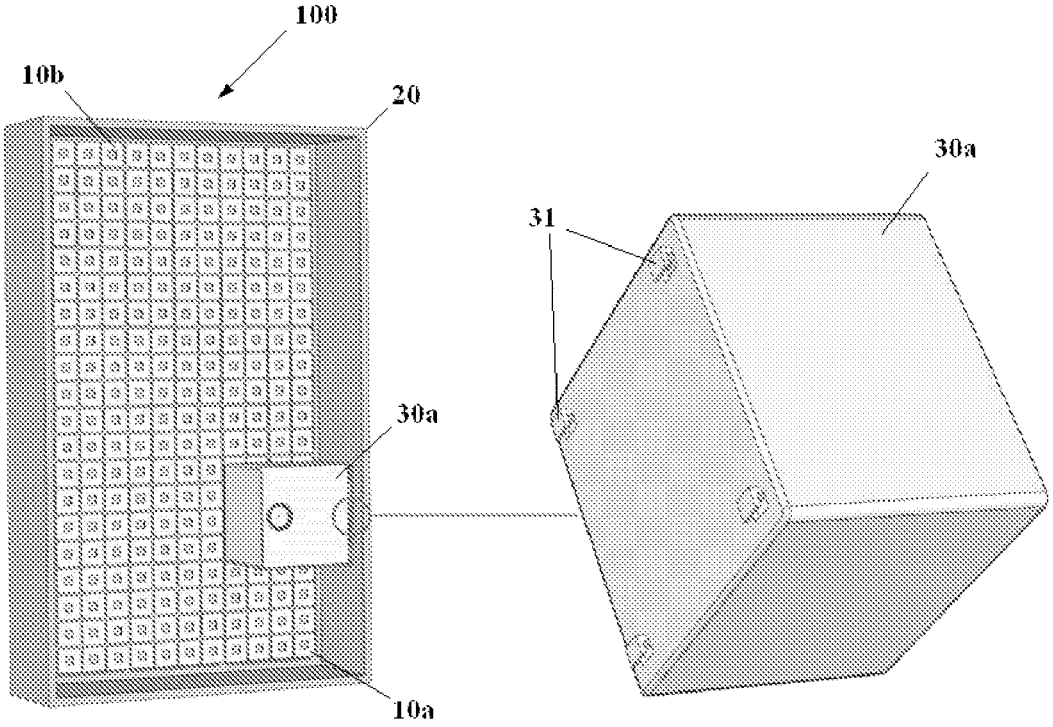
FIG. 8 illustrates a modular tiling cabinet.
Figure 9:
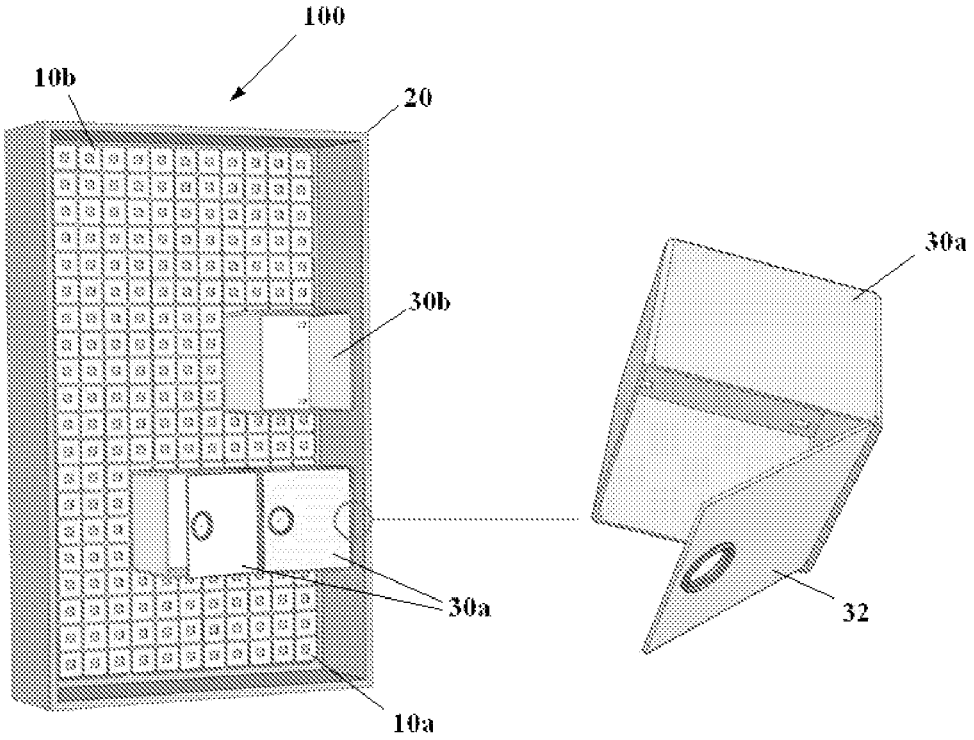
FIG. 9 illustrates a modular tiling cabinet.

As shown in FIGS. 8 through 13, modular tiling cabinet 100 can further include any suitable organizational items in customizable ways. In FIGS. 8 and 9, storage cubes 30*a* and 30*b* can be releasably secured to a modular tile by inserting rear mounting member 31 into a central opening of a unit of the modular tile. A plurality of storage cubes, such as 30*a* and 30*b*, can be included in modular tiling cabinet 100 in a customizable way. Storage cube 30*a* can further have swing door 32.

Figure 10:
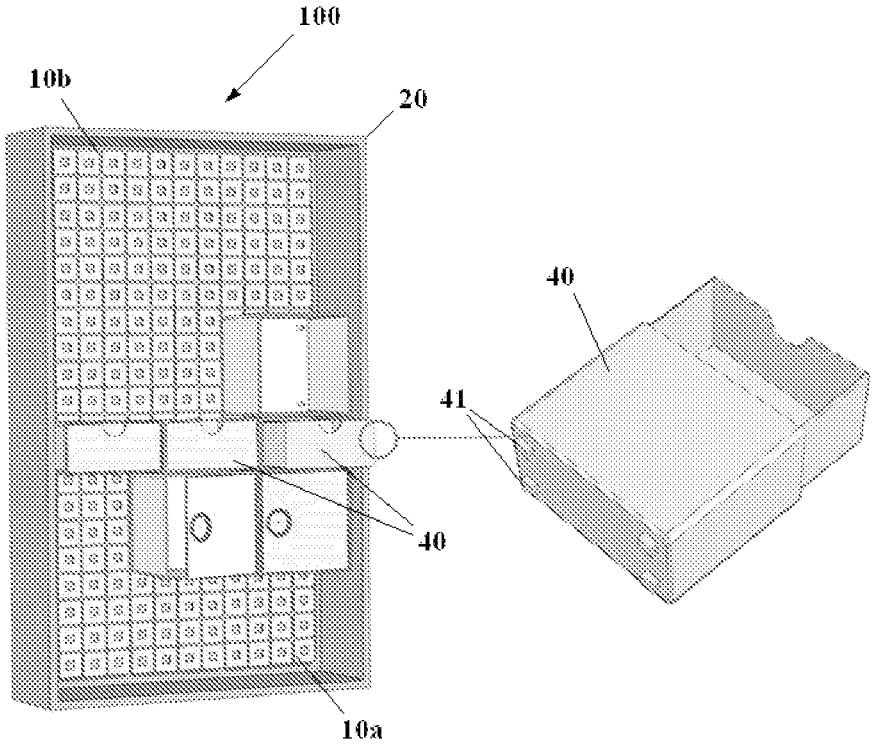
FIG. 10 illustrates a modular tiling cabinet.

In FIG. 10, drawer 40 can be releasably secured to the modular tile by inserting rear mounting member 41 into a central opening of a unit of the modular tile. A plurality of drawers 40 can be included in modular tiling cabinet 100 in a customizable way.

Figure 11:
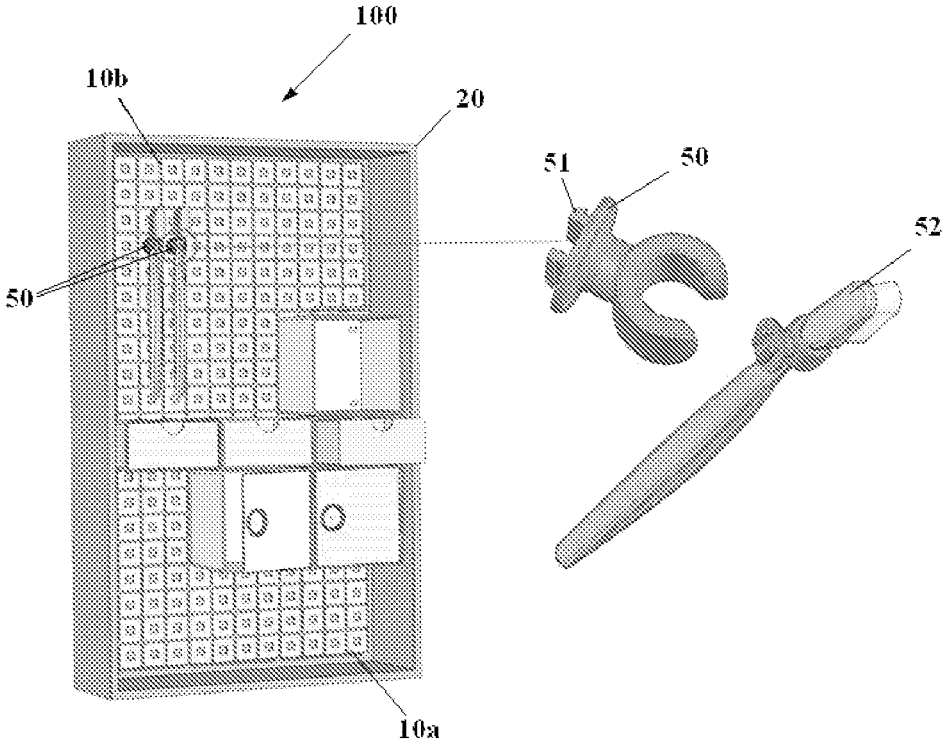
FIG. 11 illustrates a modular tiling cabinet.

Likewise, in FIG. 11, utility clip 50 can be releasably secured to the modular tile by inserting rear mounting member 51 into a central opening of a unit of the modular tile. Utility clip 50 can be used to hold toothbrush 52 or any suitable tool or gadget.

Figure 12:
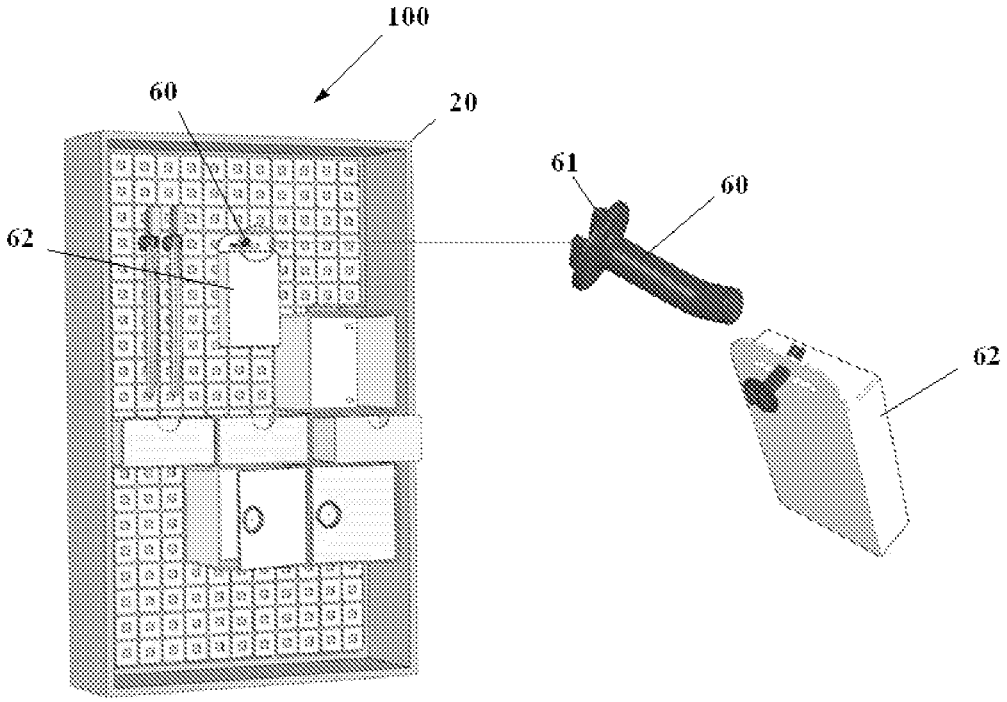
FIG. 12 illustrates a modular tiling cabinet.

In FIG. 12, hook 60 can be releasably secured to the modular tile by inserting rear mounting member 61 into a central opening of a unit of the modular tile. Hook 60 can be used to hold storage box 62 or any suitable tool or gadget.

Figure 13:
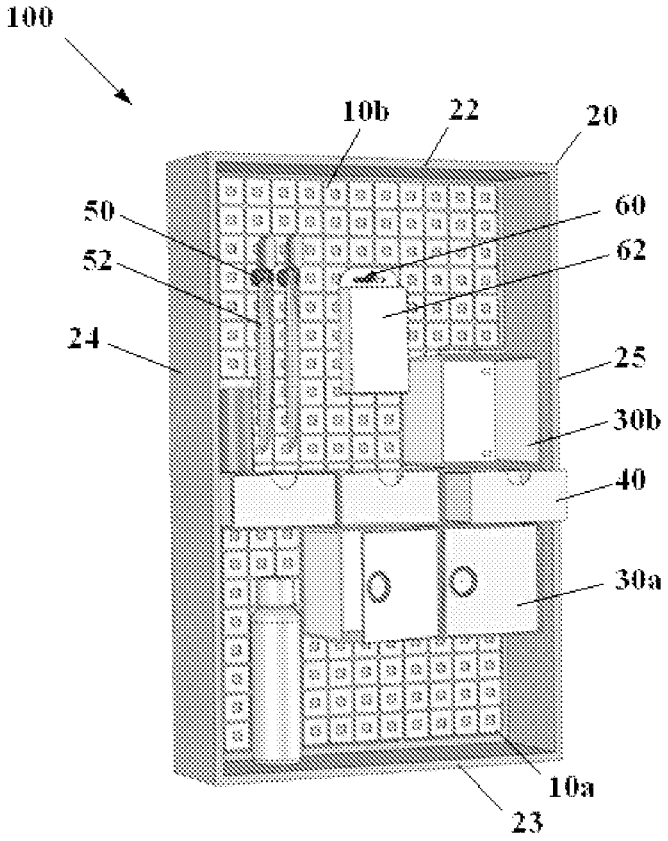
FIG. 13 illustrates a modular tiling cabinet.

As shown in FIG. 13, modular tiling cabinet 100 can include any suitable organizational items, such as storage cubes 30*a* and 30*b*, drawer 40, utility clip 50, and hook 60, in customizable ways. Housing 20 can arranged to have space for other storage box, tool, or gadget.

The modular tiles, such as 10*a* and 10*b*, can be attached to rear wall 21 of housing 20 with screws or adhesive tape. In other embodiments, a hardware connector (e.g., a screw, nail, rivet, weld, adhesive, or braze joint) can be used to attach modular tile to rear wall 21.

In some embodiments, at least one hardware connector (e.g., a screw, nail, rivet, weld, adhesive, or braze joint) can be used to mount the modular tile to any suitable surface, such as a wall of a garage, rear wall of a closet, kitchen wall, or any surface that the homeowner chooses to use for organized storage.

While the invention has been shown and explained in the embodiment described herein, it is to be understood that the invention should not be confined to the exact showing of the drawings, and that any variations, substitutions, and modifications are intended to be comprehended within the spirit of the invention. Other embodiments are within the claims.

What is claimed is:

1. A modular tile adapted for mounting onto a flat surface, comprising a panel including four edges, a front surface and a back surface, each of two adjacent edges including an edge connector being flat and having a lengthwise dimension larger than a thickness of the edge connector and each of two other edges including an edge receiver including an upper edge and a lower edge and a space between the upper edge and the lower edge for receiving the edge connector, the space extending along the edge having a length to receive the lengthwise dimension of the edge connector; and a plurality of flat units having a unit front and an unit back, wherein each flat unit comprises a central opening with two dimensions with a first dimension smaller than a second dimension, the first dimension being on the front surface of the panel such that the front surface of the panel is formed from the unit fronts of the plurality of flat units and the second dimension being on the back surface of the panel such that the back surface of the panel is formed from the unit backs of the plurality of back units and wherein the panel is configured to be mounted on a flat surface with the second dimension located between the first dimension and the flat surface and with the second dimension in contact with the flat surface;

wherein each modular tile is a 2×4, 3×3, 4×4, 3×5, 5×5, 5×6, 5×7, 7×7, 5×8, 6×8, or 8×8 unit configuration;

wherein the central opening with the first dimension is smaller than the central opening with the second dimension in every direction.

2. The modular tile of claim 1, wherein at least two modular tiles are connected by releasably securing an edge connector of a first modular tile to an edge receiver of a second modular tile.

3. The modular tile of claim 1, comprising a metal.

4. The modular tile of claim 1, comprising a plastic.

5. The modular tile of claim 1, wherein each flat unit is in a shape of a square.

6. The modular tile of claim 1, wherein each flat unit is in a shape of a hexagon.

7. The modular tile of claim 1, comprising a drawer unit or a storage cube unit having a rear mounting member configured to releasably secure to the modular tile by engaging at least one central opening and extending into a region between the first dimension and the second dimension.

8. A modular system, comprising:

a housing adapted for mounting onto a flat surface, the housing comprising a rear wall joined to a forwardly projecting top wall, bottom wall, and a pair of side walls to define a forwardly open chamber; and a modular tile attached to the rear wall of the housing, the modular tile comprising a panel including four edges, a front surface and a back surface, each of two adjacent edges including an edge connector being flat and having a lengthwise dimension larger than a thickness of the edge connector and each of two other edges including an edge receiver including an upper edge and a lower edge and a space between the upper edge and the lower edge for receiving the edge connector, the space extending along the edge having a length to receive the lengthwise dimension of the edge connector; and a plurality of flat units having a unit front and an unit back, wherein each flat unit comprises a central opening with two dimensions with a first dimension smaller than a second dimension, the first dimension being on the front surface of the panel such that the front surface of the panel is formed from the unit fronts of the plurality of flat units and the second dimension being on the back surface of the panel such that the back surface of the panel is formed from the unit backs of the plurality of back units and wherein the panel is configured to be mounted on a flat surface with the second dimension located between the first dimension and the flat surface and with the second dimension in contact with the flat surface, wherein each modular tile is a 2×4, 3×3, 4×4, 3×5, 5×5, 5×6, 5×7, 7×7, 5×8, 6×8, or 8×8 unit configuration;

wherein the central opening with the first dimension is smaller than the central opening with the second dimension in every direction wherein each modular tile includes an edge connector and an edge receiver including an upper edge and a lower edge and a space between the upper edge and the lower edge for receiving the edge connector.

9. The system of claim 8, comprising a drawer unit or a storage cube unit having a rear mounting member configured to releasably secure to the modular tile by engaging at least one central opening and extending into a region between the first dimension and the second dimension.

10. An organizer system, comprising:

at least one modular tile, the modular tile comprising a panel including four edges, a front surface and a back surface, each of two adjacent edges including an edge connector being flat and having a lengthwise dimension larger than a thickness of the edge connector and each of two other edges including an edge receiver including an upper edge and a lower edge and a space between the upper edge and the lower edge for receiving the edge connector, the space extending along the edge having a length to receive the lengthwise dimension of the edge connector, and a plurality of flat units having a unit front and an unit back, wherein each unit comprises a central opening with two dimensions with a first dimension smaller than a second dimension, the first dimension being on the front surface of the panel such that the front surface of the panel is formed from the unit fronts of the plurality of flat units and the second dimension being on the back surface of the panel such that the back surface of the panel is formed from the unit backs of the plurality of back units and wherein the panel is configured to be mounted on a flat surface with the second dimension located between the first dimension and the flat surface and with the second dimension in contact with the flat surface, wherein the modular tile is a 2×4, 3×3, 4×4, 3×5, 5×5, 5×6, 5×7, 7×7, 5×8, 6×8, or 8×8 unit configuration; and a drawer unit or a storage cube unit having a rear mounting member configured to releasably secure to the modular tile by engaging at least one central opening and extending into a region between the first dimension and the second dimension;

wherein the central opening with the first dimension is smaller than the central opening with the second dimension in every direction.

11. A method of assembling a modular tiling system, comprising:

providing at least two modular tiles, wherein each modular tile comprises:

a panel including four edges, a front surface and a back surface, each of two adjacent edges including an edge connector being flat and having a lengthwise dimension larger than a thickness of the edge connector and each of two other edges including an edge receiver including an upper edge and a lower edge and a space between the upper edge and the lower edge for receiving the edge connector, the space extending along the edge having a length to receive the lengthwise dimension of the edge connector; and a plurality of flat units having a unit front and an unit back, wherein each flat unit comprises a central opening with two dimensions with a first dimension smaller than a second dimension, the first dimension being on the front surface of the panel such that the front surface of the panel is formed from the unit fronts of the plurality of flat units and the second dimension being on the back surface of the panel such that the back surface of the panel is formed from the unit backs of the plurality of back units and;

connecting two modular tiles by releasably securing an edge connector of a first modular tile to an edge receiver of a second modular tile; and mounting the assembled modular tiles onto a flat surface, wherein each modular tile is a 2×4, 3×3, 4×4, 3×5, 5×5, 5×6, 5×7, 7×7, 5×8, 6×8, or 8×8 unit configuration, wherein the second dimension is located between the first dimension and the flat surface, and wherein the second dimension is in contact with the flat surface;

wherein the central opening with the first dimension is smaller than the central opening with the second dimension in every direction.

12. The method of claim 11, wherein the modular tile comprises a metal or a plastic.

13. The method of claim 11, wherein each flat unit is in a shape of a square or a hexagon.

14. The method of claim 11, further comprising releasably securing a drawer unit or a storage cube unit having a rear mounting member to the modular tile by engaging at least one central opening and extending into a region between the first dimension and the second dimension.

* * * * *